United States Patent [19]

Nasuta, Jr. et al.

[11] 4,086,427

[45] Apr. 25, 1978

[54] COMMON SHIELD-TERMINATING CONNECTION IN SHIELDED WIRE BUNDLE

[75] Inventors: Anthony T. Nasuta, Jr.; James W. Walsh, both of Baltimore, Md.

[73] Assignee: Westinghouse Electric Corporation, Pittsburgh, Pa.

[21] Appl. No.: 693,985

[22] Filed: Jun. 8, 1976

[51] Int. Cl.[2] ..... H01R 5/02; H01R 5/10

[52] U.S. Cl. ..... 174/88 C; 174/78; 174/DIG. 8; 428/117; 428/118

[58] Field of Search ..... 174/35 R, 35 C, 35 MS, 174/36, 75 C, 78, 88 R, 88 C, 95, 97, 103, DIG. 8; 339/143 R, 143 C; 428/116, 117, 118

[56] References Cited

U.S. PATENT DOCUMENTS

| | | | |
|---|---|---|---|
| 2,889,394 | 6/1959 | Aune | 174/88 C |
| 3,280,246 | 10/1966 | Lawson et al. | 174/88 C |
| 3,679,534 | 7/1972 | Weinberg | 428/118 |
| 4,016,356 | 4/1977 | McLoughlin | 174/DIG. 8 X |

*Primary Examiner*—Laramie E. Askin
*Attorney, Agent, or Firm*—D. F. Straitiff

[57] ABSTRACT

A plurality of shielded wires are held bundled and electrically interconnected at their braided-shield exteriors by a compacted metallic thin-wall honeycomb member whose collapsed cell walls encircle the wires individually. The honeycomb wrap around the wire bundle is encircled by a heat-shrunk sleeve of plastic tubing, and the collapsed cell walls are held electrically joined to the braided shields by conductive adhesive.

6 Claims, 3 Drawing Figures

COMMON SHIELD-TERMINATING CONNECTION IN SHIELDED WIRE BUNDLE

BACKGROUND OF THE INVENTION

1. Field of the Invention

Interconnection of shields at terminus of shielded wire bundles.

2. Description of the Prior Art

A preliminary novelty search uncovered the prior art described in the following U.S. Pat. Nos. Koller et al. 2,798,113; Aune 2,889,394; Forney Jr. 3,200,190; Lawson et al. 3,280,246; May et al. 3,322,885; Schwartz 3,465,092; and Bakker 3,821,463.

Of these patents, only Lawson et al, Schwartz, and May et al deal with joining together the shields of a shielded wire bundle. Among these three, Lawson et al and Schwartz clamp pigtail shield ends of a wire bundle between two rings held together by crimping in one case and by screw threads in the other case. May et al casts an electrically conductive plastic around the shield-bared ends of a wire group.

The ring clamping techniques requires the stripping of a length of the braided shield ends from around the wire to form pigtails and care in locating such pigtails for clamping between the ring members. The casting technique can involve considerable skill in the handling and containing of the conductive plastic in its uncured, flowable, state.

SUMMARY OF THE INVENTION

The present invention differs from the above prior art techniques in the use of the compacted metallic honeycomb member which accepts the shield-exposed wire ends in its individual cells without requiring their first being stripped for pigtailing of the braided shields, and the disposition of the wires in discrete honeycomb cells acts to maintain relative positioning of the wires while assuring contact with such member. Compaction of the honeycomb member around the wires passing through its cells can be obtained with relative ease, and the application of a conductive adhesive onto the shield around each wire prior to its insertion into a respective honeycomb member cell can be attained also with relative ease. The same result might be obtained with even greater ease by a precoating of the inner honeycomb cell walls with a heat-softenable conductive plastic material. In either case, the conductive adhesive material can serve as a securing function and/or a coating function that prevents oxidation of the joints between the wire shields and the honeycomb cell walls during prolonged subsequent use of the finished wire bundle. Heat shrinking of a plastic boot or sleeve around the compacted honeycomb member may complete the assembly. A particular honeycomb member can serve to accommodate a variety of wire sizes and numbers.

DESCRIPTION OF A PREFERRED EMBODIMENT

Figure 1:
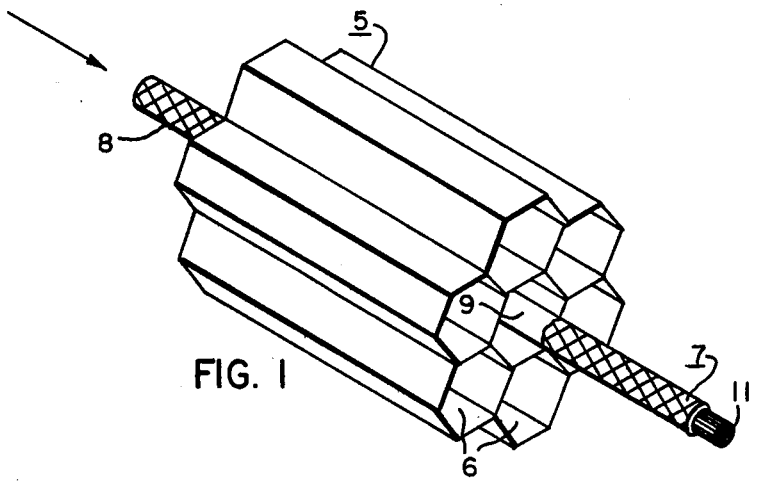
FIG. 1 is an isometric three-dimensional view of a braided-shield wire being inserted into a cell of a metallic honeycomb member during assembly of the connected-shield wire bundle in accord with the present invention.

Referring to FIG. 1, the present invention comprises a honeycomb member 5 of conductive material such as aluminum, having open-ended cells 6 of sufficient size to readily accommodate insertion of the ends of wires 7, one of which is shown, having braided-shields 8 on their exterior. Where the interior of the honeycomb cells 6 are not coated with a conductive adhesive, each individual braided shield 8 may be coated with such an adhesive 9 in the region of disposition within the cells 6. In either case, pre-coated cells or coated shields, the conductive adhesive may be of the thermosetting or thermoplastic type, or merely of the type cured by solvent evaporation.

Figure 2:
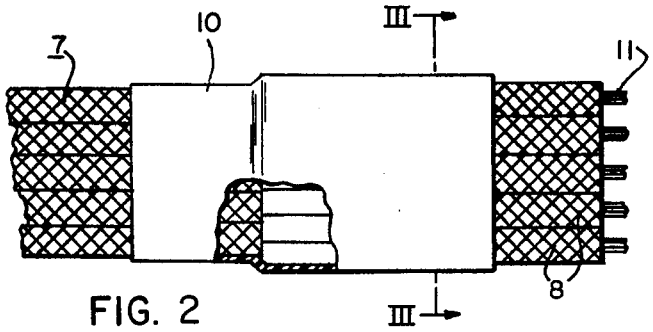
FIG. 2 is a side view of the end of a shielded-wire bundle with interconnected and wrapped shield ends as per the present invention.
Figure 3:
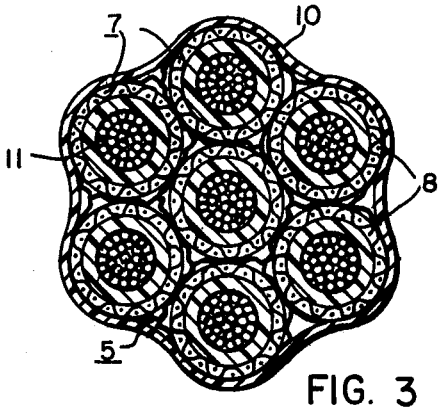
FIG. 3 is a section view of the wire bundle taken along the line III—III in FIG. 2 and showing the compacted honeycomb member cells in tight embrasure of the braided shields in accord with the present invention.

Once having inserted the required number of shielded wires 7 into respective honeycomb cells 6, the honeycomb is compacted around the wires by squeezing inwardly. After which, a plastic sleeve 10 or lacing (not shown) may be fitted over the compacted cell and wire bundle and tightened or heat shrunk in place to produce the shield-interconnected compact wire bundle terminal assembly as shown in FIGS. 2 and 3. The end-stripped wire 11 projecting beyond the shield juncture assembly may be introduced to such as a connector socket for soldering in place, and usually one of the braided shields or a separate wire would electrically join the interconnected shielding to the connector shell.

It will be understood that unshielded wires also may be fed through the honeycomb member together with the shielded ones and need not be routed outside such member.

We claim:

1. A wire assembly comprising:

a plurality of wires having electrical shields on their exteriors, and a conductive honeycomb member having cells through which said wires pass, said honeycomb member being compacted around said electrical shields in electrical contact therewith.

2. The wire assembly of claim 1, further comprising:

a confining means in tight-fitting encirclement of the compacted honeycomb member.

3. The wire assembly of claim 2, wherein the confining means is in the form of a heat-shrink plastic sleeve.

4. The wire assembly of claim 1, further comprising:

a conductive adhesive material intercoating the walls of said honeycomb member and the shields on said wires.

5. The wire assembly of claim 4, further comprising a sleeve of heat-shrink material in tight-fitting encirclement of the compacted honeycomb member.

6. The wire assembly of claim 1, wherein said wires pass through said honeycomb cells individually.

* * * * *